US011396788B2

(12) United States Patent
Newton

(10) Patent No.: US 11,396,788 B2
(45) Date of Patent: Jul. 26, 2022

(54) FLUID ACTIVATED METAL ALLOY SHUT OFF DEVICE

(71) Applicant: Halliburton Energy Services, Inc., Houston, TX (US)

(72) Inventor: Daniel Craig Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/124,666

(22) Filed: Dec. 17, 2020

(65) Prior Publication Data

US 2022/0195828 A1 Jun. 23, 2022

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

| | | | | |
|---|---|---|---|---|
| 3,602,303 | A * | 8/1971 | Blenkarn | E21B 33/076 166/360 |
| 6,915,848 | B2 | 7/2005 | Thomeer et al. | |
| 7,231,975 | B2 * | 6/2007 | Lavaure | E21B 33/134 166/285 |
| 7,510,001 | B2 | 3/2009 | Spring | |
| 7,640,965 | B2 | 1/2010 | Bosma et al. | |
| 7,699,111 | B2 * | 4/2010 | Brooks | E21B 33/1208 166/373 |
| 9,206,659 | B2 | 12/2015 | Zhang et al. | |
| 11,047,203 | B2 * | 6/2021 | Fripp | E21B 33/1277 |
| 2005/0034863 | A1 | 2/2005 | Dillenbeck et al. | |
| 2008/0060814 | A1 | 3/2008 | Badalamenti et al. | |
| 2016/0222764 | A1 | 8/2016 | Rorvik | |
| 2020/0240235 | A1 | 7/2020 | Fripp et al. | |

FOREIGN PATENT DOCUMENTS

| | | |
|---|---|---|
| WO | 2019-164499 | 8/2019 |
| WO | 2020-145938 | 7/2020 |

OTHER PUBLICATIONS

International Search Report and Written Opinion for Application No. PCT/US2020/067125, dated Sep. 14, 2021.

(Continued)

*Primary Examiner* — Aaron L Lembo
(74) *Attorney, Agent, or Firm* — Scott Richardson; C. Tumey Law Group PLLC

(57) ABSTRACT

A variety of methods, systems, and apparatus are disclosed. In one example, a well tool is deployed downhole on a conveyance (e.g., tubing string) with the well tool in an open condition, wherein a flow path of the tool is in fluid communication with the tubing string. A swellable metallic material is arranged along the flow path. A service operation may be performed while the tool is in the open condition, including flowing a well fluid down the tubing string and through the flow path of the tool. After performing the service operation, an activation fluid may be delivered downhole to the well tool to activate the swellable metallic material to close the flow path of the tool.

20 Claims, 8 Drawing Sheets

(56) References Cited

OTHER PUBLICATIONS

NOV,—ReACT Liner Shoe, Available at https://www.nov.com/products/react-electronic-liner-shoe. Accessed Dec. 8, 2020.
Weatherford—Remote close shoe, RFID-Enabled Tools, Delivering efficiency, flexibility, and control in challenging downhole environments, 2018.
Baker—Wellbore Isolation Valve Available at https://www.bakerhughes.com/integrated-well-services/integrated-well-construction/completions/isolation-valves. Accessed Dec. 8, 2020.
HCT—eRED Remote Open Close Tools, Available at https://www.halliburton.com/en-US/ps/well-dynamics/well-completions/intelligent-completions/remote-open-close-technology/default.html. Accessed Dec. 8, 2020.
Rubicon Oilfield International, Downhole shut off collar, Available at https://www.rubicon-oilfield.com/products/downhole-shut-off-valve/, Accessed Dec. 8, 2020.

* cited by examiner

FLUID ACTIVATED METAL ALLOY SHUT OFF DEVICE

BACKGROUND

Well tools are typically included within a tubular string or conveyance and tripped downhole for later use. Examples of such tools include liner and casing shoes, circulation sleeves, squeeze packers, and bridge plugs. Such well tools are typically actuated downhole by transferring mechanical movement from the surface downhole to the tool, such as by applying rotation, tension or compression via the tubing string the tool is deployed on to generate the actuation force. For various reasons, such as due to rig time, inability to adequately transfer to depth of tool, mechanical movement of the string is not always technically or financially viable for a given job.

Other well tools are designed to be run into the hole open and then closed. Methods of closing such a well tool including dropping from surface to the downhole tool a ball, dart or radio frequency identification (RFID) tag and/or the use of an electronics module that activates based on environmental variables, such as pressure, temperature, and time. Still other well tools rely on a differential pressure to actuate an associated piston. These may also require dropping a ball or dart to generate a closed system needed to generate a differential pressure. All of these methods have complexity, cost and time-based impacts. Deployable plugging devices, in particular, have a risk of not reaching the necessary depth, becoming damaged, or may require too much rig time to implement.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
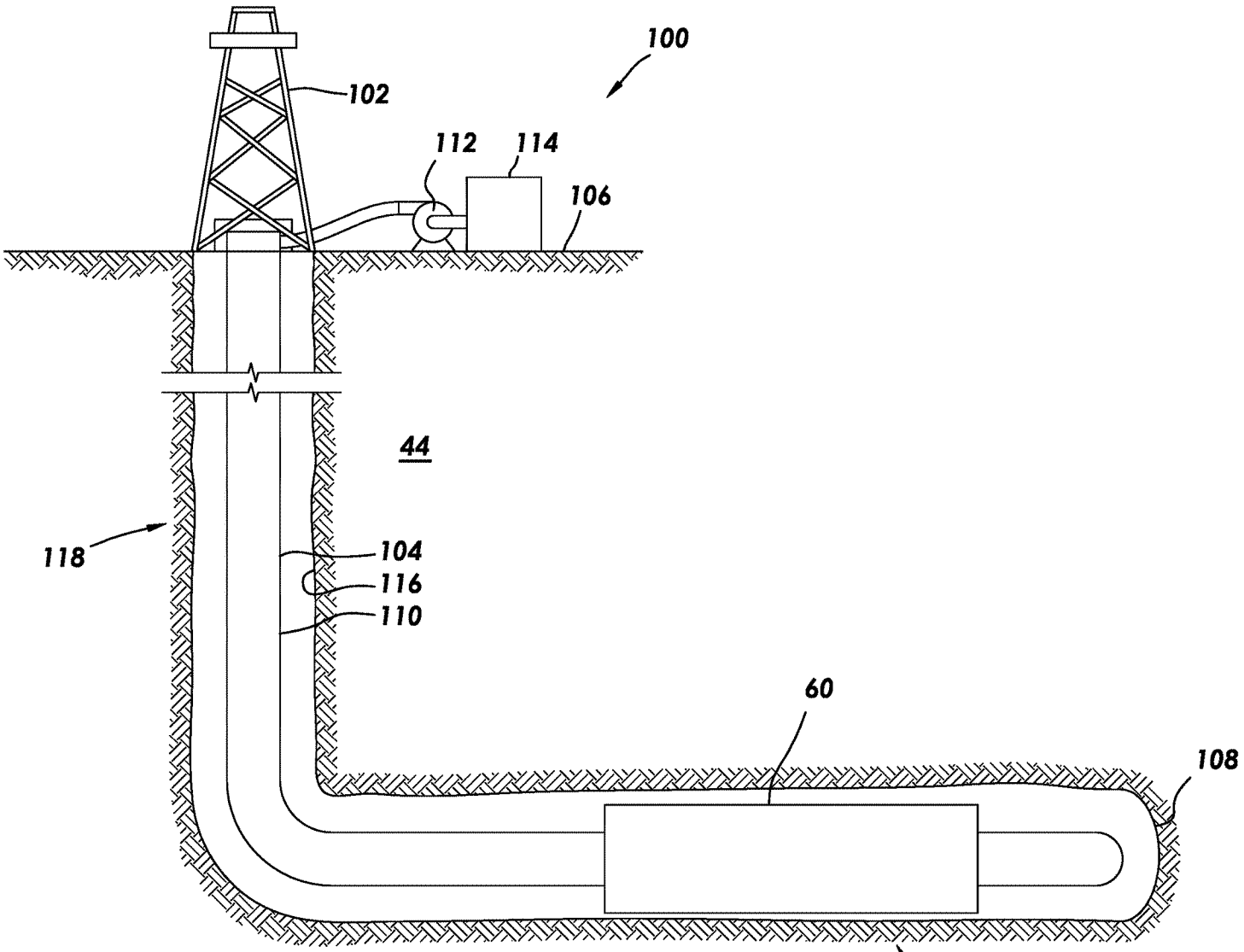
FIG. 1 is a schematic, elevation view of a well site for recovery of hydrocarbons from an underground formation, using a well tool according to aspects of this disclosure.

Apparatus and methods are disclosed for deploying a well tool in an open condition and closing the well tool using a swellable metallic material that swells in response to contact with a certain activation fluid. The activation fluid may be released on command, such as by circulating the activation fluid to the well tool from the surface, and directed downhole to the well tool to activate the swellable metallic material and close a flow path to the well tool. Desirably, this allows the flow path to be closed without having to drop a ball or dart, and without the need for complex electronics.

In an example, the well tool is run into the well in an open condition, with swellable metallic material arranged in proximity to a flow path or fluid port. The well tool may be arranged on a tubular string, allowing well fluids to flow through the tubular string and through the tool without actuating the well tool. For example, fluids such as water or mud may be delivered downhole during well construction, cement may be delivered during a cementing operation, or a stimulation fluid such as acidizing or fracturing treatment may be flowed through the well tool while in the open condition to perform the associated service operation. When it is desired to close the flow path of the tool, a specific activation fluid may be delivered to the tool that reacts with the swellable metallic material to expand the swellable metallic material in place and close the flow path to the tool. Once the flow path is closed, formation fluids may be prevented from undesirably flowing back up through the tool. Also, fluid pressure may be applied as needed above the tool. By pre-arranging the swellable metallic material within the tool prior to tripping the tool downhole, the tool may be actuated at any time in response to circulation of an activation fluid, without the need for dropping a ball or dart to plug the flow path.

A swellable metallic material according to this disclosure may be any material that sufficiently expands in response to contact with an activation fluid to actuate the tool. The swellable metallic material may expand in one or more dimensions, depending on geometry and space constraints. In one or more examples, the swellable metallic material may be arranged radially outwardly of the flow path and expand radially inwardly to close the flow path when activated.

Although various materials may expand to some extent in contact with a fluid, few if any such materials have the requisite material properties to seal downhole in the applications described herein, to expand from a ring or sleeve shape to completely close the central flow path of a well tool, and to then maintain that seal and withstand the caustic and extreme environment of a downhole tool. The category of swellable metallic materials that may be particularly chosen for use with the disclosure are swellable metallic materials. The activation fluid for swellable metallic materials may comprise a brine. The swellable metallic materials are a specific class of metallic materials that may comprise metals and metal alloys and may swell by the formation of metal hydroxides. The swellable metallic materials swell by undergoing metal hydration reactions in the presence of brines to form metal hydroxides.

In one example, the swellable metallic materials may be placed in proximity to a selected flow path and then activated by the brine to cause, induce, or otherwise participate in the reaction that causes the material to close the flow path. To close the flow path, the swellable metallic material may increase its volume, become displaced, solidify, thicken, harden, or a combination thereof. The swellable metallic materials may swell in high-salinity and/or high-temperature environments where elastomeric materials, such as rubber, can perform poorly.

In one or more embodiments, the metal hydroxide occupies more space than the base metal reactant. This expansion in volume allows the swellable metallic material to form a seal at the interface of the swellable metallic material and any adjacent surfaces. For example, a mole of magnesium has a molar mass of 24 g/mol and a density of 1.74 g/cm3 which results in a volume of 13.8 cm/mol. Magnesium hydroxide has a molar mass of 60 g/mol and a density of 2.34 g/cm3 which results in a volume of 25.6 cm/mol. 25.6 cm/mol is 85% more volume than 13.8 cm/mol. As another example, a mole of calcium has a molar mass of 40 g/mol and a density of 1.54 g/cm3 which results in a volume of 26.0 cm/mol. Calcium hydroxide has a molar mass of 76 g/mol and a density of 2.21 g/cm3 which results in a volume of 34.4 cm/mol. 34.4 cm/mol is 32% more volume than 26.0 cm/mol. As yet another example, a mole of aluminum has a molar mass of 27 g/mol and a density of 2.7 g/cm3 which results in a volume of 10.0 cm/mol. Aluminum hydroxide has a molar mass of 63 g/mol and a density of 2.42 g/cm3 which results in a volume of 26 cm/mol. 26 cm/mol is 160% more volume than 10 cm/mol. The swellable metallic material comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metallic material.

Examples of suitable metals for the swellable metallic material include, but are not limited to, magnesium, calcium, aluminum, tin, zinc, beryllium, barium, manganese, or any combination thereof. Preferred metals include magnesium, calcium, and aluminum. Examples of suitable metal alloys for the swellable metallic material include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these nonmetallic elements include, but are not limited to, graphite, carbon, silicon, boron nitride, and the like. In some examples, the metal is alloyed to increase reactivity and/or to control the formation of oxides. In some examples, the metal alloy is also alloyed with a dopant metal that promotes corrosion or inhibits passivation and thus increased hydroxide formation. Examples of dopant metals include, but are not limited to nickel, iron, copper, carbon, titanium, gallium, mercury, cobalt, iridium, gold, palladium, or any combination thereof. In examples where the swellable metallic material comprises a metal alloy, the metal alloy may be produced from a solid solution process or a powder metallurgical process. The sealing element comprising the metal alloy may be formed either from the metal alloy production process or through subsequent processing of the metal alloy. As used herein, the term "solid solution" may include an alloy that is formed from a single melt where all of the components in the alloy (e.g., a magnesium alloy) are melted together in a casting. The casting can be subsequently extruded, wrought, hipped, or worked to form the desired shape for the sealing element of the swellable metallic material. Preferably, the alloying components are uniformly distributed throughout the metal alloy, although intragranular inclusions may be present, without departing from the scope of the present disclosure.

It is to be understood that some minor variations in the distribution of the alloying particles can occur, but it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase. A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metallic material.

In some alternative examples, the swellable metallic material comprises an oxide. As an example, calcium oxide reacts with water in an energetic reaction to produce calcium hydroxide. 1 mole of calcium oxide occupies 9.5 $cm^3$ whereas 1 mole of calcium hydroxide occupies 34.4 $cm^3$ which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

A swellable metallic material may be selected that does not degrade into the brine. As such, the use of metals or metal alloys for the swellable metallic material that form relatively water-insoluble hydration products may be preferred. For example, magnesium hydroxide and calcium hydroxide have low solubility in water. In some examples, the metal hydration reaction may comprise an intermediate step where the metal hydroxides are small particles. When confined, these small particles may lock together. Thus, there may be an intermediate step where the swellable metallic material forms a series of fine particles between the steps of being solid metal and forming a seal. The small particles have a maximum dimension less than 0.1 inch and generally have a maximum dimension less than 0.01 inches.

In some embodiments, the small particles comprise between one and 100 grains (metallurgical grains).

In some alternative examples, the swellable metallic material is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluoroelastomers, ethylene-based rubber, and PEEK. In some embodiments, the dispersed swellable metallic material may be cuttings obtained from a machining process.

In some examples, the metal hydroxide formed from the swellable metallic material may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metallic material. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metallic material may allow the swellable metallic material to form additional metal hydroxide and continue to swell.

FIG. 1 is a schematic, elevation view of a well site 100 for recovery of hydrocarbons from an underground formation 44. A large support structure generally indicated at 102 may include, for example, a derrick, a lifting mechanism such as a hoist or crane, and other equipment for supporting a conveyance, which in this example is illustrated as a tubing string 104, extending from a surface 106 of the well site 100 down to a toe 108 of a well 110 drilled in the formation 44. Although a tubing string is shown, other suitable conveyances may include wireline or coiled tubing depending on the particular application. The well 110 includes a wellbore 116 drilled into the formation 44. The wellbore includes a vertical section 118 followed by a lateral section 120. The tubing string 104 may represent any of a variety of tubing strings used in oil and gas industry including but not limited to a drill string used in drilling the well 110, a completion string used in completing the well 110 in preparation for production, a production tubing string used to control production of formation fluids, or a work string for servicing the well at any stage of the well's construction and service life. A tool 60 supported on the end of the tubing string 104 may be any of a variety of tools used to service the well during its construction or service life, which service operations involve the delivery of a well fluid downhole through the tubing string 104 to the tool 60. In this example, the tool 60 is deployed in the lateral section 120 of the well 110 but could alternatively be deployed anywhere along the wellbore 116.

A pump 112 is provided at the surface 106 for pumping fluid from a fluid source 114 downhole through the tubing string 104 to the tool 60. The pump 112 may be used to pump a well fluid such as drilling fluid (mud), casing cement, a stimulation fluid, or other fluid that would be flowed through the tool 60 during a service operation. The fluid source 114 may also include a separation activation fluid pumped downhole after completion of the service operation to activate a swellable metallic material and close a flow path of the tool 60 according to the disclosure. Although a single pump and fluid source are illustrated in this schematic drawing, different fluids used to service the well in different service operations, and the activation fluid may be kept in separate vessels and/or pumped separately and at different times, optionally using different pumps for different fluids and tasks. Although an onshore well site is depicted, aspects of this disclosure may alternatively be used in offshore applications.

Figure 2:
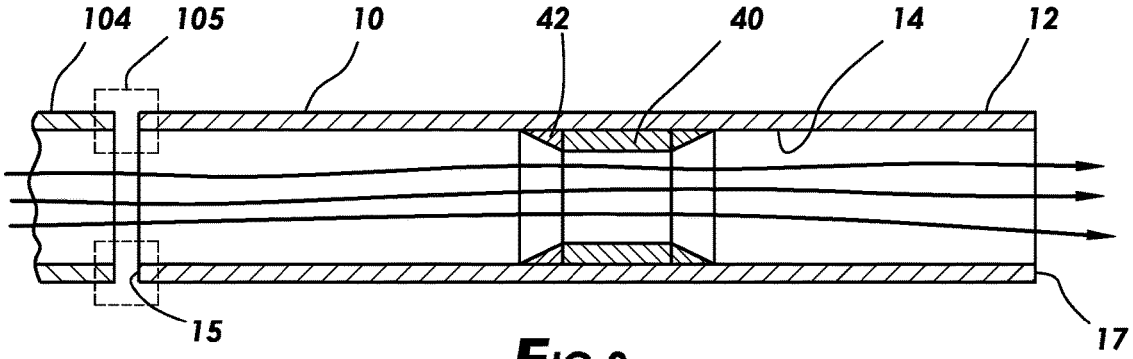
FIG. 2 is a side view of one configuration of a tool body defining an example flow path.
Figure 3:
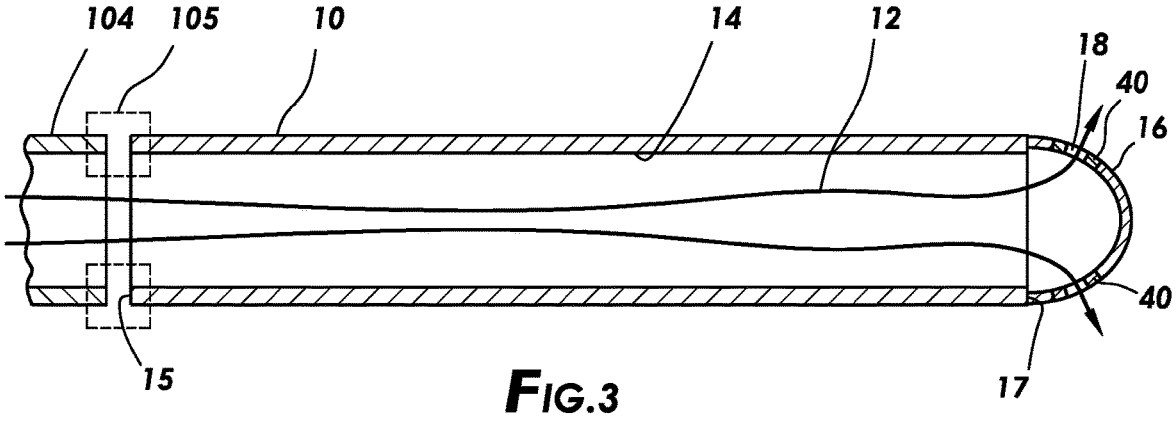
FIG. 3 is a side view of another configuration of the tool body defining another flow path.
Figure 4:
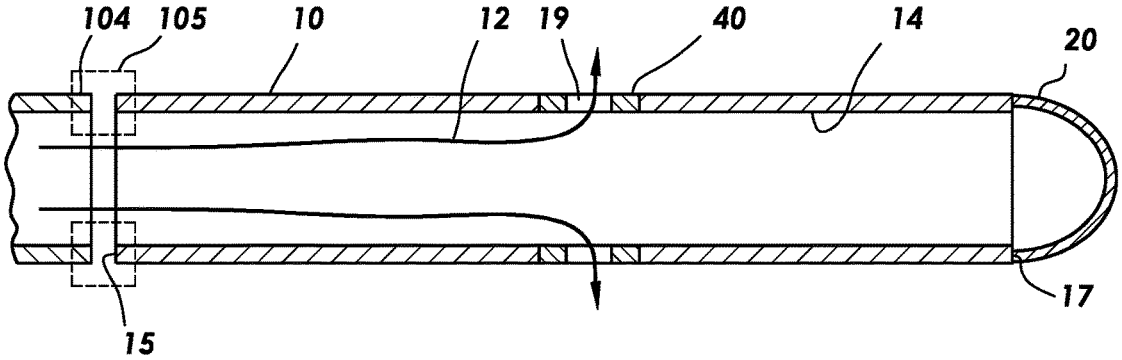
FIG. 4 is a side view of another configuration of the tool body defining another flow path.

FIGS. 2-4 provide three examples of a flow path 12 for the well tool 60 of FIG. 1. A flow path according to any given configuration allows flow through the well tool to or from the formation in which the well is formed. The flow path, when initially open, allows flow either downhole through the tool or uphole through the tool. The flow may be, for example, of a well fluid down through the tubing string on which the tool is deployed and to the formation. Alternatively, the flow may be of a formation fluid through the tool and up the tubing string to surface. A swellable metallic material may be provided anywhere along the flow path and arranged such that, upon activation, the flow path is closed, such as to prevent the flow of fluids uphole or downhole through the tool that was allowed when the flow path was initially open.

FIG. 2 is a side view of one configuration of a tool body 10 defining an example flow path generally indicated at 12. The tool body 10 is deployable on the tubing string 104 using a connector schematically indicated at 105 according to any suitable connector type in the art. The tool body 10 has a central bore 14 that is in line with the tool body, and thus in fluid communication with the tubing string 104 at an upper end 15 of the tool body 10. A swellable metallic material 40, such as described in detail above is arranged along the central bore 14, optionally in a ring encircling the central bore 14. The swellable metallic material may be retained by a retaining structure such as optional end rings 42. Additional components, machined or produced by additive manufacturing (i.e., 3D printed), may also be used adjacent the swellable metallic material to facilitate forming a seal when later activated. The swellable metallic material 40 is shown in an inactivated state, such that the tool body 10 is in an open condition. In the open condition, fluid may flow along the flow path 12, which extends from the upper end 15 of the tool body 10, along the central bore 14, past the swellable metallic material 40, and to a lower end 17 of the tool body. Thus, in the open condition, fluid may flow downhole from the tubing string 104 through the tool body 10, and may exit the tool body 10 at the lower end 17 to a formation (not shown) in which the tool may be deployed. In at least some cases, formation fluid may alternatively flow up through the tool body 10 to the tool string 104, although valves may also be included as discussed below to limit flow to one direction even in the open condition. When it is desired to close flow through the tool body 10, an activation fluid may be delivered to the tool and flowed along the flow path 12, over the swellable metallic material 40, to plug the central bore 14 with the swellable metallic material 40.

FIG. 3 is a side view of another configuration of the tool body 10 defining another example of the well tool flow path 12. As in FIG. 2, the tool body 10 is deployable on the tubing string 104 using a connector 105 with the central bore 14 in fluid communication with the tubing string 104. A ported bullnose or shoe 16 is provided on the lower end 17 of the tool body 10. The ported bullnose 16 includes a plurality of flow ports 18. The swellable metallic material 40, such as a swellable metallic material described in detail above, is arranged around or within the flow ports 18 while still allowing flow through the flow ports 18 in the inactivated state. The swellable metallic material may be retained by a retaining structure such as described in FIG. 2. The swellable metallic material 40 is shown in an inactivated state, such that the tool body 10 is in an open condition. In the open condition, fluid may flow along the flow path 12, which extends from the upper end 15 of the tool body 10, along the central bore 14, past the swellable metallic material 40, and out the flow ports 18 at the lower end 17 of the tool body 10. Thus, in the open condition, fluid may flow downhole from the tubing string 104 through the tool body 10, and may exit the tool body 10 at the flow ports 18 to a formation (not shown) in which the tool may be deployed. In at least some cases, formation fluid may alternatively flow up through the flow ports 18 and into the tool body 10 to the tool string 104. Again, valves may also be included as discussed below to limit flow to one direction even in the open condition. An activation fluid may be delivered to the tool and flowed along the flow path 12, over the swellable metallic material 40 in the flow ports 18, to close the flow ports 18 with the swellable metallic material 40 as further discussed below.

FIG. 4 is a side view of another configuration of a tool body 10 defining another example of the flow path 12. As with FIGS. 1 and 2, the tool body 10 is deployable on the tubing string 104 using a connector 105 with the central bore 14 in fluid communication with the tubing string 104. A non-ported bullnose or shoe 20 is optionally provided on the lower end 17 of the tool body 10. The non-ported bullnose 20 blocks any flow at the lower end 17 of the tool body 10. In the open condition, all of the flow is diverted out through side ports 19 arranged along the tool body 10 and in fluid communication with the central bore 14. The swellable metallic material 40 is arranged around or within the side ports 19 while initially allowing flow through the side ports 19 while in the inactivated state. The swellable metallic material may be retained by a retaining structure such as described in FIG. 2. In the open condition, fluid may flow along the flow path 12, which extends from the upper end 15 of the tool body 10, along the central bore 14, and over the swellable metallic material 40 as it flows out the side ports 19. Thus, in the open condition, fluid may flow downhole from the tubing string 104 through the tool body 10, and may exit the tool body 10 at the side ports 19 to a formation (not shown) in which the tool may be deployed. Again, valves may also be included as discussed below to limit flow to one direction even in the open condition. An activation fluid may be delivered to the tool along the flow path 12, over the swellable metallic material 40 in the side ports 19, to close the side ports 19 with the swellable metallic material 40 as further discussed below.

The foregoing examples of tool bodies, flow paths, and/or features or variations thereof are incorporated into the following example tools in FIGS. 5-17. The examples are not to scale unless otherwise noted. It should be recognized that elements of one configuration may be combined with elements of any other configuration to the extent practicable. As such, the disclosure is not limited to just the discrete examples shown. Additionally, the valves, ports, and other elements shown below are provided as non-limiting examples. A myriad of alternative valve types and other elements may be incorporated within the scope of this disclosure in addition to these examples. The swellable metallic material may be capable of sustaining at least 50 pounds per square inch (0.347 MPA) in some applications, and as much as 500 pounds per square inch (3.47 MPa), once activated to close the flow path. Accordingly, the swellable metallic material may have sufficient structural integrity to be used without any other valves in a tool body.

Figure 5:
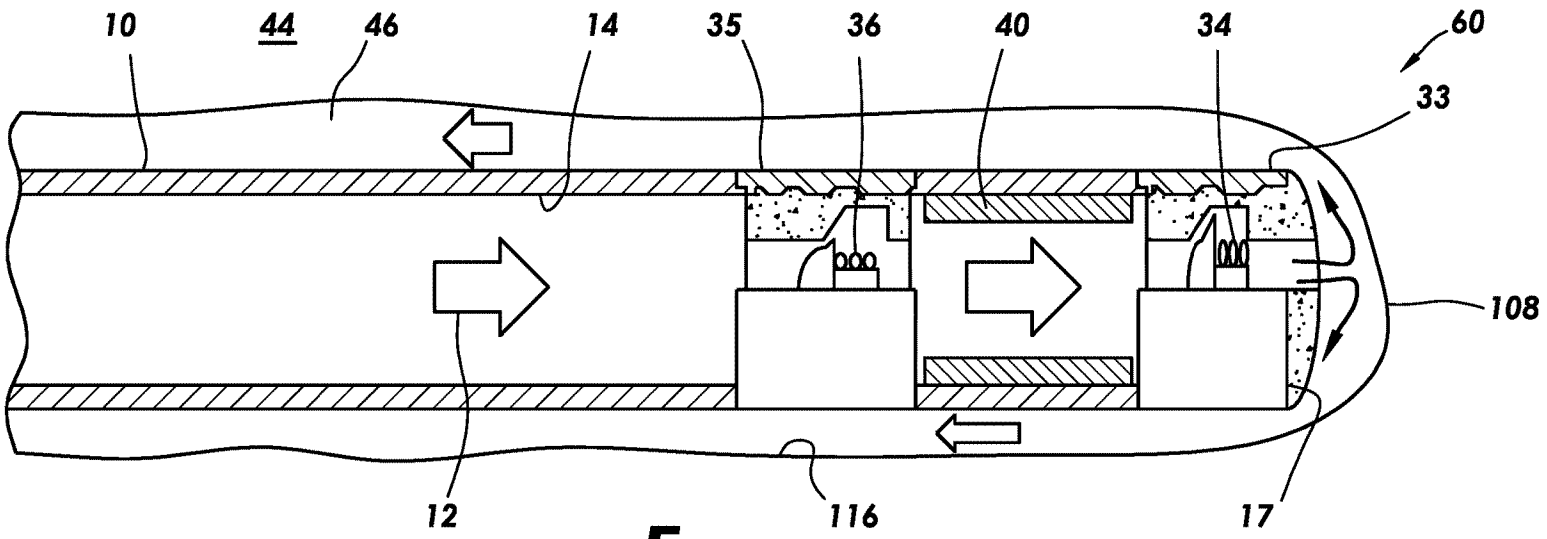
FIG. 5 is an example configuration of the well tool incorporating the general tool body configuration of FIG. 2.

FIG. 5 is an example configuration of the well tool 60 incorporating aspects of the tool body configuration of FIG. 2. A float shoe 33 is disposed at the lower end 17 of the tool body 10 and a float valve 35 axially spaced above the float shoe 33. Each of the float shoe 33 and float valve 35 include a respective spring-biased valve element (e.g., a poppet) 34 and 36, respectively that are movable to open or close flow. The valve elements 34, 36 are biased to a closed position and are configured to resist flow uphole through the tool. During a service operation, or otherwise prior to closing the flow path 12, the float shoe 33 and float valve 35 may be operated in tandem. The swellable metallic material 40 is arranged in the central bore 14 of the tool body 10, between the float shoe 33 and float valve 35. During a service operation, a well fluid may be circulated downhole along the flow path 12, including through the central bore 14, through the float shoe 33, ring of swellable metallic material 40, and float valve 35, and out through the lower end 17. Flow exiting the lower end 17 encounters the toe (lower end) 108 of the wellbore 116, or other closure, plug seal, etc., causing fluid to be diverted back up through an annulus 46 between the tool body 10 and wellbore 116. The flow path 12 may remain open for a service operation to be performed involving the delivery of well fluid downhole through the tool 60. When it is desired to close flow through the tool, the activation fluid may be delivered to the tool 60, along the flow path 12 and over the swellable metallic material 40.

Figure 6:
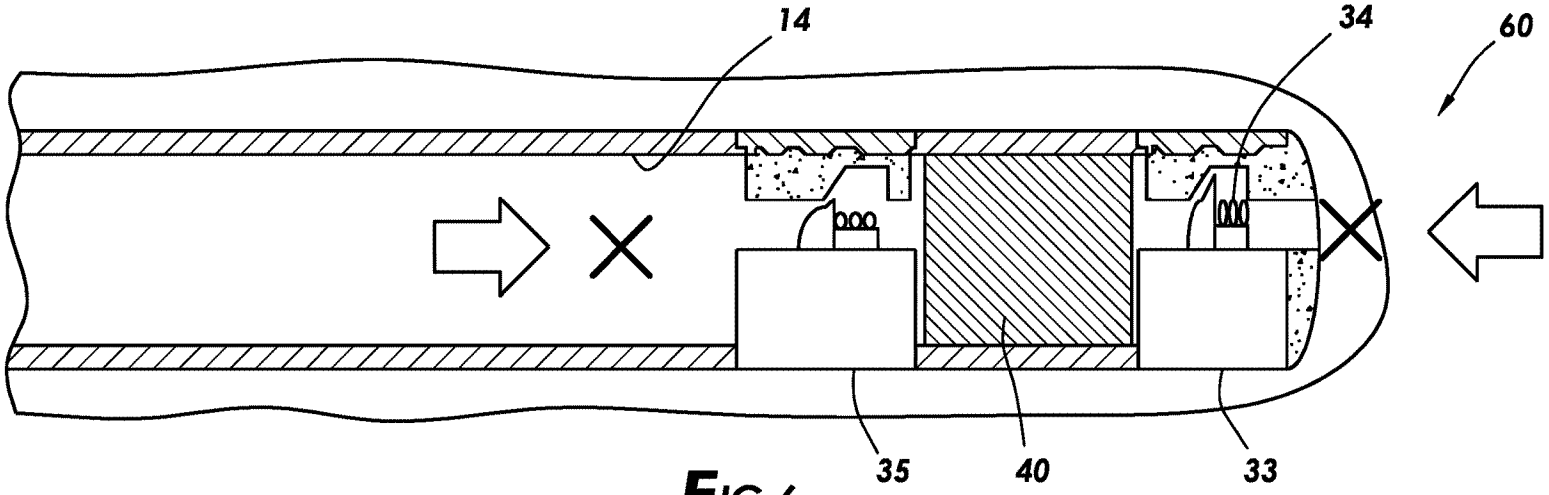
FIG. 6 shows the well tool of FIG. 5 after the swellable metallic material has been activated by exposure of the swellable metallic material to the flow of activation fluid through the tool.

FIG. 6 shows the well tool 60 of FIG. 5 after the swellable metallic material 40 has been activated by exposure of the swellable metallic material 40 to the flow of activation fluid through the tool 60. This has caused the swellable metallic material 40 to expand radially inwardly, to close the central bore 14, thereby closing flow through the flow path 12. The swellable metallic material 40 is now able to hold differential pressure between a pressure from above and below even without the valve elements 34, 36. Circulation of further well fluid downhole through the tool 60 is now prevented. Flow of formation fluids up through the tool 60 is also prevented by the expanded swellable metallic material 40, which may reinforce the flow control provided by the valve element 34 of the float shoe 33.

Figure 7:
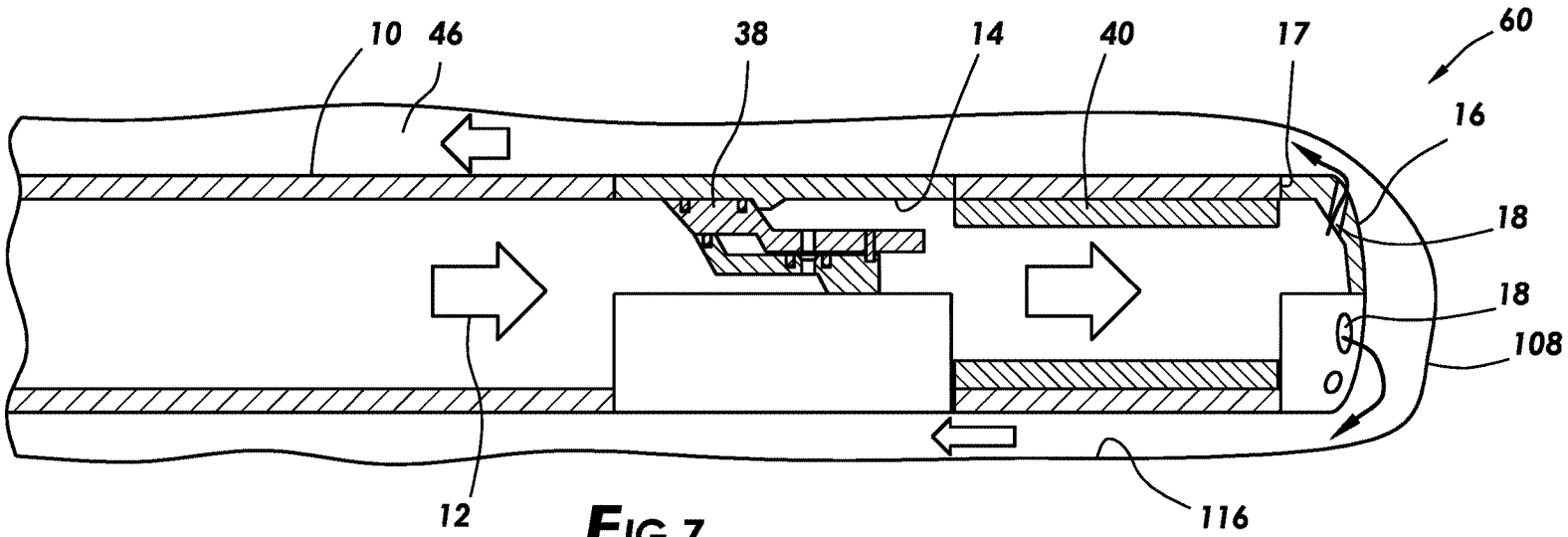
FIG. 7 is another example configuration of the well tool combining aspects of the tool body configurations of FIGS. 2 and 3.

FIG. 7 is another example configuration of the well tool 60 combining aspects of the tool body configurations of FIGS. 2 and 3. A ported bullnose or shoe 16 is provided on the lower end 17 of the tool body 10 and includes a plurality of flow ports 18. The swellable metallic material 40, such as a swellable metallic material described in detail above, is arranged, optionally in a ring shape, in the central bore 14 of the tool body 10. An isolation valve 38 is disposed above the swellable metallic material 40 for controlling flow through the tool 60 prior to activation of the swellable metallic material 40. The isolation valve 38 is another example of a valve. During a service operation, a well fluid may be circulated downhole along the flow path 12, including through the central bore 14, through the isolation valve 38 and ring of swellable metallic material 40, out through the lower end 17 at the ports 18 of the bullnose 16. Flow exiting the lower end 17 encounters the toe (lower end) 108 of the wellbore 116, or other closure, plug seal, etc., causing fluid to be diverted back up through an annulus 46 between the tool body 10 and wellbore 116. The flow path 12 may remain open for a service operation to be performed involving the delivery of well fluid downhole through the tool 60. When it is desired to close flow through the tool, the activation fluid may be delivered to the tool 60, along the flow path 12 and over the swellable metallic material 40.

Figure 8:
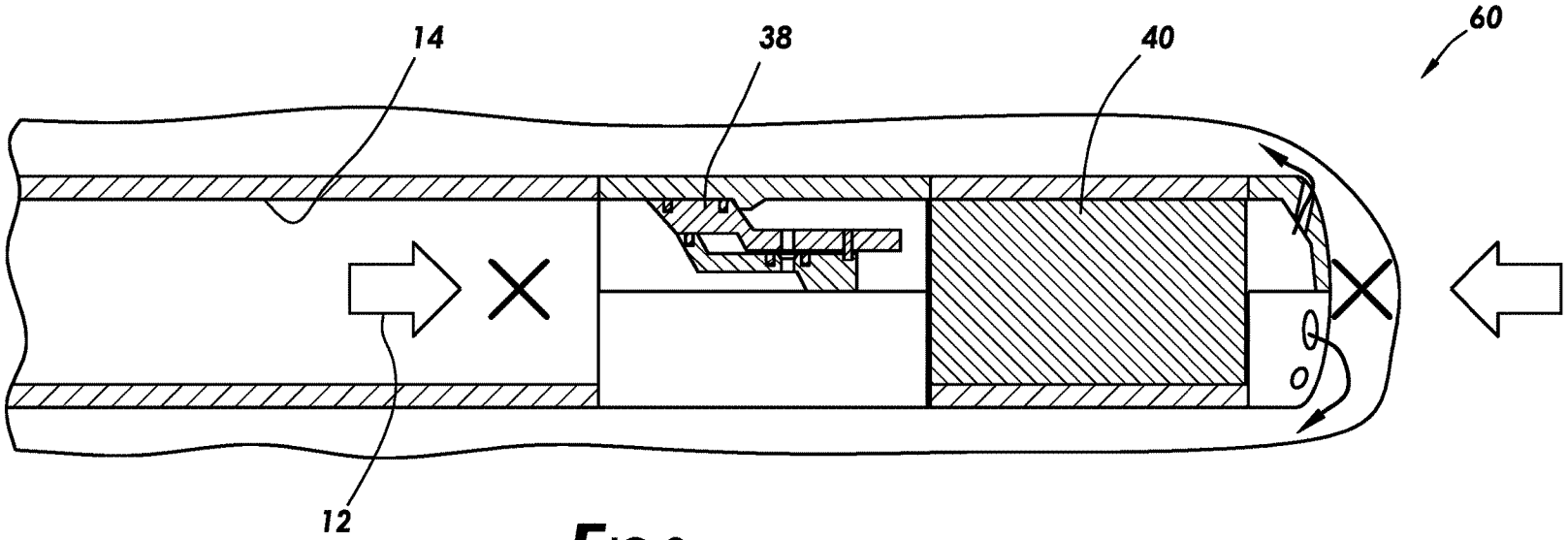
FIG. 8 shows the well tool of FIG. 7 after the swellable metallic material has been activated by exposure of the swellable metallic material to the flow of activation fluid through the tool.

FIG. 8 shows the well tool 60 of FIG. 7 after the swellable metallic material 40 has been activated by exposure of the swellable metallic material 40 to the flow of activation fluid through the tool 60. This has caused the swellable metallic material 40 to expand radially, to close the central bore 14, thereby closing flow through the flow path 12. The swellable metallic material 40 is now able to hold differential pressure between a pressure from above and below even without the use of the isolation valve 38. Circulation of further well fluid downhole through the tool 60 is now prevented. Flow of formation fluids up through the tool 60 is also prevented by the expanded swellable metallic material 40, which may reinforce the flow control provided by the isolation valve 38.

Figure 9:
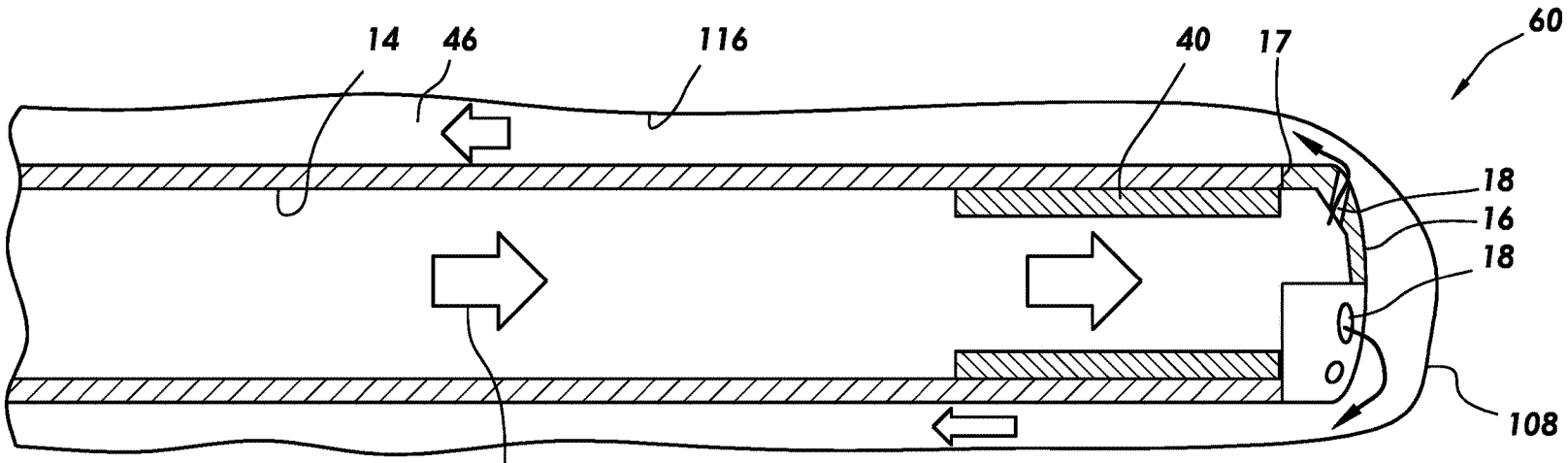
FIG. 9 is another example configuration of the well tool using a ported bullnose or shoe provided on the lower end of the tool body with a plurality of flow ports.

FIG. 9 is another example configuration of the well tool 60 using a ported bullnose or shoe 16 provided on the lower end 17 of the tool body 10 with a plurality of flow ports 18. The swellable metallic material 40, such as a swellable metallic material described in detail above, is again arranged, optionally in a ring shape, in the central bore 14 of the tool body 10. In this example, no other valve is provided in the tool body 10. During a service operation, a well fluid may be circulated downhole along the flow path 12, including through the central bore 14, through the ring of swellable metallic material 40, out through the lower end 17 at the ports 18 of the bullnose 16. Flow exiting the lower end 17 encounters the toe (lower end) 108 of the wellbore 116, or other closure, plug seal, etc., causing fluid to be diverted back up through an annulus 46 between the tool body 10 and wellbore 116. The flow path 12 may remain open for a service operation to be performed involving the delivery of well fluid downhole through the tool 60. When it is desired to close flow through the tool, the activation fluid may be delivered to the tool 60, along the flow path 12 and over the swellable metallic material 40.

Figure 10:
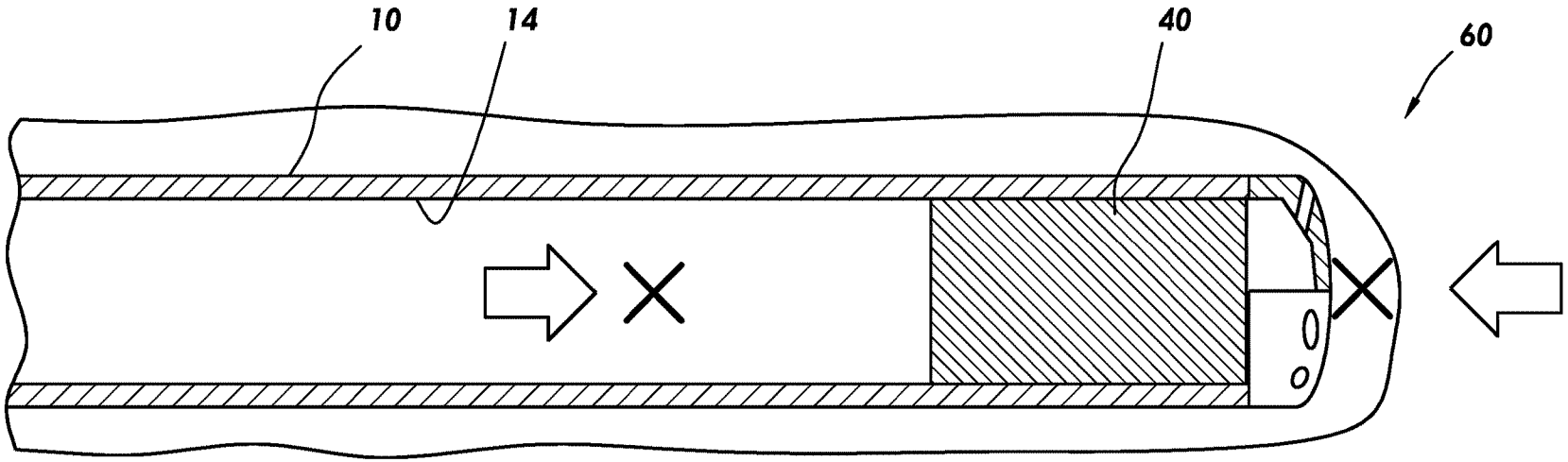
FIG. 10 shows the well tool of FIG. 9 after the swellable metallic material has been activated by exposure of the swellable metallic material to the flow of activation fluid through the tool.

FIG. 10 shows the well tool 60 of FIG. 9 after the swellable metallic material 40 has been activated by exposure of the swellable metallic material 40 to the flow of activation fluid through the tool 60. This has caused the swellable metallic material 40 to expand radially, to close the central bore 14, thereby closing flow through the flow path 12. The swellable metallic material 40 is now able to hold differential pressure between a pressure from above and below even without any other valves being present. Circulation of further well fluid downhole through the tool 60 is now prevented. Flow of formation fluids up through the tool 60 is also prevented by the expanded swellable metallic material 40. An advantage of this embodiment is the simplicity and low cost of a tool body 10 with minimal complications or features, that is still capable of closing flow in response to delivery of an activation fluid.

Figure 11:
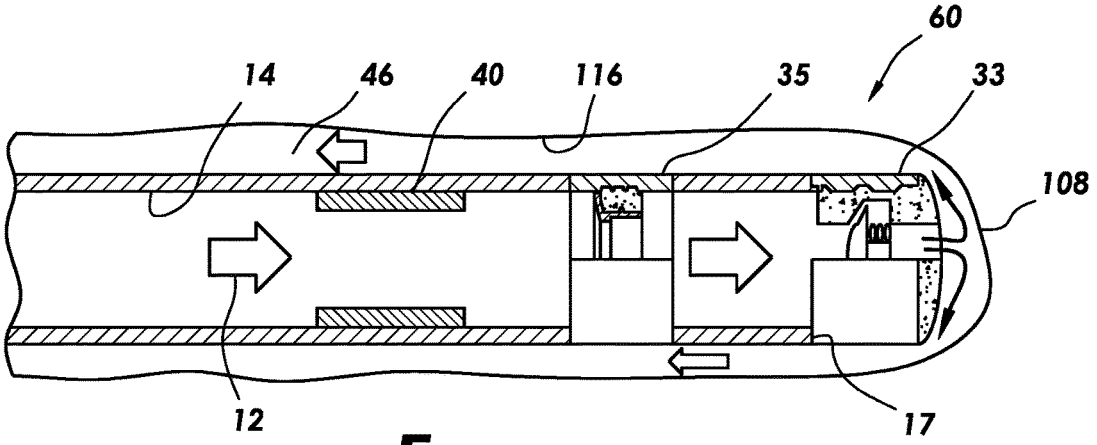
FIG. 11 is another example configuration of the well tool incorporating the float shoe at the lower end of the tool body and the float valve axially spaced above the float shoe.

FIG. 11 is another example configuration of the well tool 60 incorporating the float shoe 33 at the lower end 17 of the tool body 10 and the float valve 35 axially spaced above the float shoe 33. In this example, however, the ring of swellable metallic material 40 is above the float shoe 33 and float valve 35. During a service operation, or otherwise prior to closing the flow path 12, the float shoe 33 and float valve 35 may be operated independently or in tandem to control the flow of fluid. A well fluid may be circulated downhole along the flow path 12, including through the central bore 14, through the ring of swellable metallic material 40, float valve 35, float shoe 33, and out through the lower end 17. Flow exiting the lower end 17 encounters the toe (lower end) 108 of the wellbore 116, or other closure, plug seal, etc., causing fluid to be diverted back up through an annulus 46 between the tool body 10 and wellbore 116. The flow path 12 may remain open for a service operation to be performed involving the delivery of well fluid downhole through the tool 60. When it is desired to close flow through the tool, the activation fluid may be delivered to the tool 60, along the flow path 12 and over the swellable metallic material 40.

Figure 12:
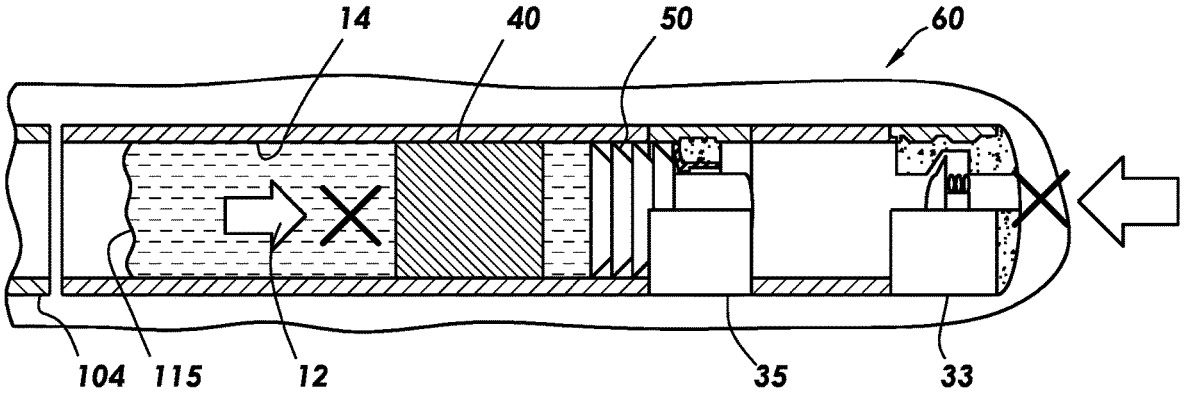
FIG. 12 shows an example of the well tool of FIG. 11 wherein the float valve is first plugged with a plug (e.g., a dart) dropped into the tool before the swellable metallic material has been activated by exposure of the swellable metallic material to activation fluid

FIG. 12 shows an example of the well tool 60 of FIG. 11 wherein the float valve 35 is first plugged with a plug (e.g., a dart) 50 dropped into the tool 60 before the swellable metallic material 40 has been activated by exposure of the swellable metallic material 40 to activation fluid. The plug 50 may be dropped prior to or along with the delivery of the activation fluid down the tool string 104. Alternatively, the activation fluid may be supplied to fill a portion of the central bore 14 above the float valve 35 with a column of activation fluid 115 in contact with the swellable metallic material 40. This has caused the swellable metallic material 40 to expand radially inwardly, to close the central bore 14, thereby closing flow through the flow path 12 from above the swellable metallic material 40. The swellable metallic material 40 is now able to hold differential pressure between a pressure from above and below even without the valve elements 34, 36. The plug 50 remains in place as a backup. Circulation of further well fluid downhole through the tool 60 is now prevented. Flow of formation fluids up through the tool 60 is also prevented by the expanded swellable metallic material 40.

Figure 13:
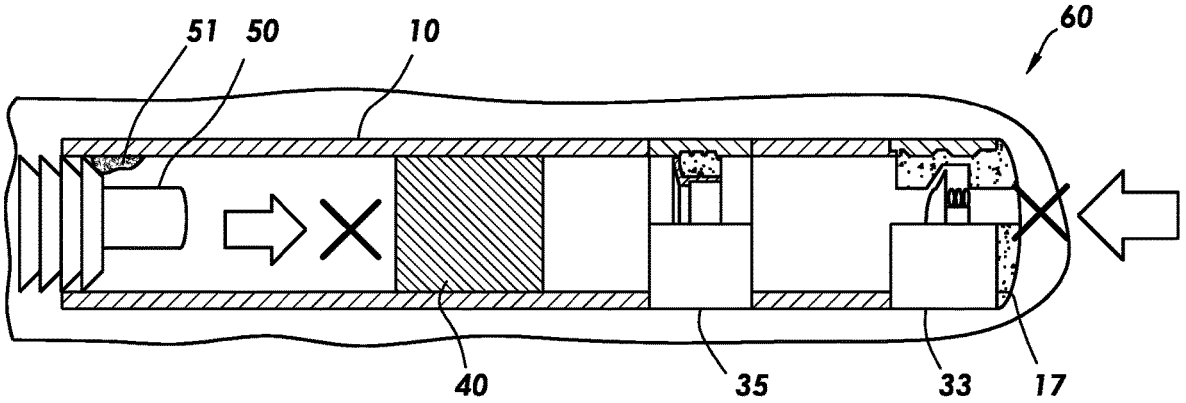
FIG. 13 is another side view of the well tool of FIG. 11, wherein the swellable metallic material has been activated as a backup, to provide isolation after a failure to plug.

FIG. 13 is another side view of the well tool 60 of FIG. 11, wherein the swellable metallic material 40 has been activated, as a backup sealing system, such as in case where the plug 50 fails to reach the landing collar 37 that may be associated with the float shoe 35. The plug 50 might not reach the landing collar 37, for example, due to a restriction 51 within the wellbore, either planned or unplanned, and the activated swellable metallic material 40 would thus prevent further flow of fluid. Again, flow through the tool 60 may be prevented by the activated swellable metallic material 40 and/or by closing the float shoe 33 at the lower end 17 of the tool body 10. In other examples, rather than being located within the central bore of the tool, the swellable metallic material could be arranged within the ID of either the float collar, float shoe or other device; between the float collar and float shoe or above one of or both the float collar and/or float shoe or any other device run as part of the pipe such as, but not limited to, shut off valves and plug or dart landing collars.

Figure 14:
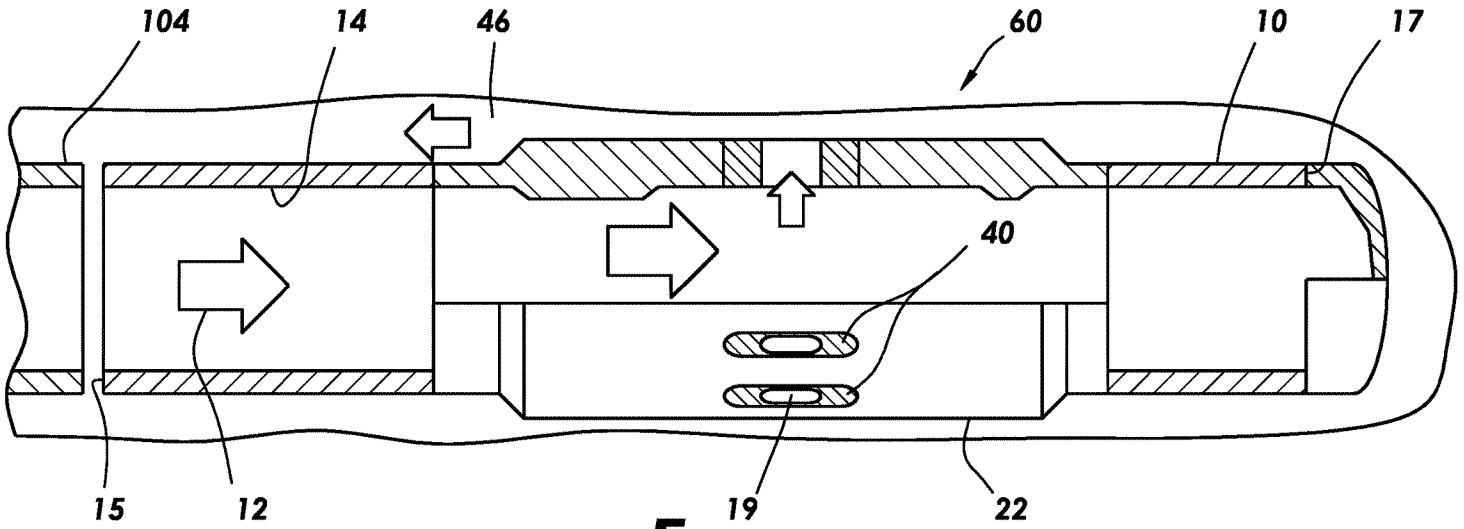
FIG. 14 is another example configuration of the well tool incorporating aspects of the tool body configuration of FIG. 3.

FIG. 14 is another example configuration of the well tool 60 incorporating aspects of the tool body configuration of FIG. 3. A non-ported (i.e., closed) bullnose or shoe 20 is provided on the lower end 17 of the tool body 10 that blocks any flow at the lower end 17 of the tool body 10. In the open condition of the tool 60 (prior to activation of the swellable metallic material 40), flow is diverted out of the tool body 10 through side ports 19 defined by a ported sub 22 along the tool body 10 directly to the annulus 46. The swellable metallic material 40 is arranged proximate to the side ports 19 while still allowing flow through the side ports 19 in the inactivated state. During a service operation, a well fluid may be circulated downhole along the flow path 12, through the central bore 14, through the side ports 19 and over the swellable metallic material 40, to the annulus 46. The flow path 12 may remain open for a service operation to be performed involving the delivery of well fluid downhole through the tool 60. When it is desired to close flow through the tool, the activation fluid may be delivered to the tool 60, along the flow path 12 and over the swellable metallic material 40.

Figure 15:
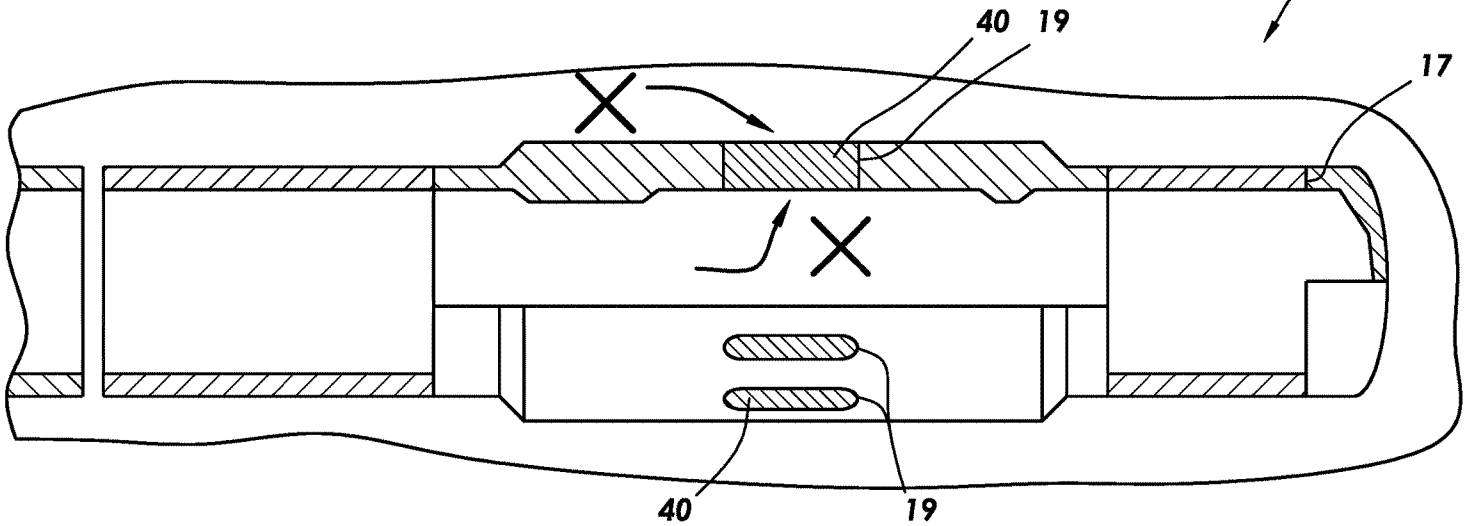
FIG. 15 shows the well tool of FIG. 14 after the swellable metallic material has been activated by exposure of the swellable metallic material to the flow of activation fluid through the tool.

FIG. 15 shows the well tool 60 of FIG. 14 after the swellable metallic material 40 has been activated by exposure of the swellable metallic material 40 to the flow of activation fluid through the tool 60. This has caused the swellable metallic material 40 to expand radially, to close the side ports 19, thereby closing flow through the flow path 12 (FIG. 14). The swellable metallic material 40 is now able to hold differential pressure between a pressure from above and below even without any other valves being present.

Figure 16:
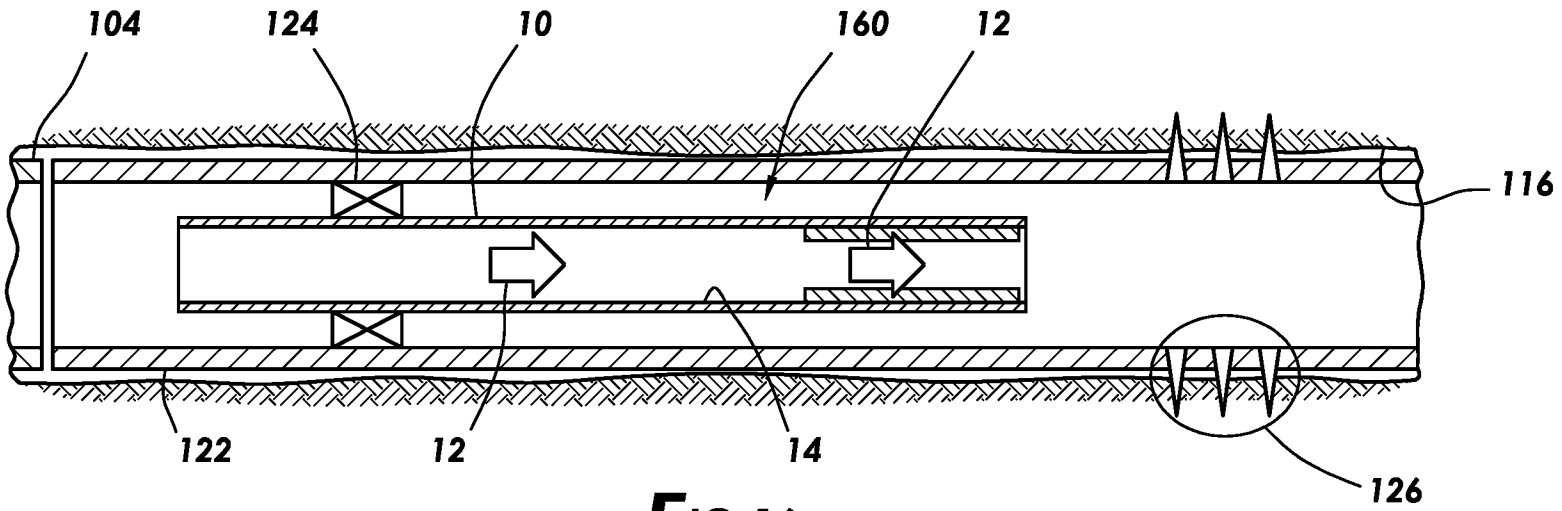
FIG. 16 is a side view of another example well tool including a bridge plug or squeeze packer deployable on a conveyance into a casing disposed in the wellbore.

FIG. 16 is a side view of another example well tool 160 including a bridge plug or squeeze packer 124 deployable on a conveyance into a casing 122 disposed in the wellbore 116. By way of example, the conveyance comprises the tubing string 104 in this example, but could alternatively comprise a wireline, coiled tubing, or other suitable conveyance. The tool body 10 of the well tool 160 may be a plug mandrel, tailpipe, or other tubing, which may be sealingly engaged with the casing 112 with the bridge plug or squeeze packer 124. The tool body 10 defines the central bore 14 along the flow path 12 that is open to a perforatable section of the casing 122 (and/or open hole portion of the wellbore 116) below it. The swellable metallic material 40 is arranged along the flow path 12, to initially allow flow of a well fluid past the swellable metallic material 40. The swellable metallic material is also arranged to close the flow path of the tool upon activation.

Figure 17:
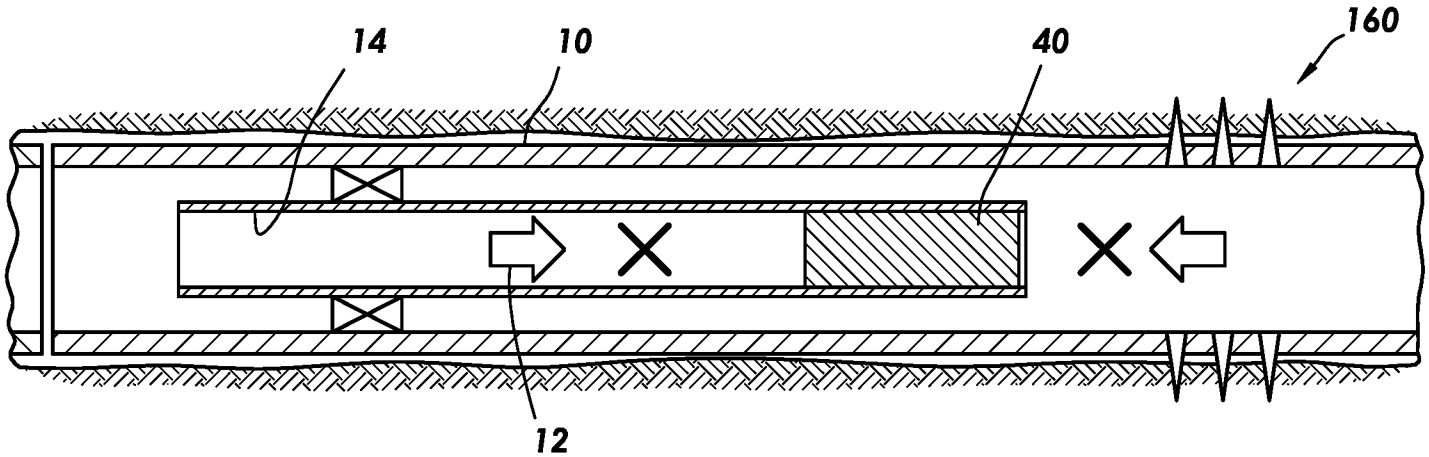
FIG. 17 shows the well tool of FIG. 16 after a well fluid has been delivered through the tool downhole through the flow path and over the swellable metallic material to close flow through the tool.

FIG. 17 shows the well tool 160 of FIG. 16 after a well fluid has been delivered through the tool 160 downhole through the flow path 12 and over the swellable metallic material 40 to close flow through the tool 160. In particular, the swellable metallic material 40 swells radially inwardly to close the central bore 14 of the tool body 10.

Accordingly, the present disclosure provides methods, systems, and apparatus wherein a flow path of a tool may initially be open for the flow of well fluids used during a service operation, and subsequently closed by activating a swellable metallic material. The swellable metallic material may be activated by delivering an activation fluid, without the need for a dropped plugging device such as a ball or plug, mechanical actuation from surface, or complex electronics. An embodiment of this disclosure may include any of the various features disclosed herein, including one or more of the following statements.

Statement 1. A method, comprising deploying a well tool downhole on a tubing string with the well tool in an open condition wherein a flow path of the tool is in fluid communication with the tubing string, and with a swellable metallic material arranged along the flow path; performing a service operation including flowing a well fluid down the tubing string and through the flow path of the tool; and after performing the service operation, delivering an activation fluid downhole to the well tool to activate the swellable metallic material to close the flow path of the tool.

Statement 2. The method of statement 1, wherein activating the swellable metallic material comprises undergoing metal hydration reactions in the presence of brines to form metal hydroxides.

Statement 3. The method of any of statements 1-2, further comprising: flowing the well fluid down the tubing string and through a central bore of the well tool in line with the tubing string and out a lower end of the central bore; and wherein the swellable metallic material is arranged on an inner diameter of the central bore and expands to close the central bore upon activation.

Statement 4. The method of any of statements 1-3, further comprising: controlling flow of a formation fluid through the well tool using one or both of a float valve and a float shoe along the central bore of the tool prior to activating the swellable metallic material.

Statement 5. The method of any of statements 1-4, further comprising: flowing the well fluid down the tubing string and out through one or more side ports of a ported sub during the service operation; and wherein the swellable metallic material is arranged in the one or more side ports and expands to close the side ports upon activation.

Statement 6. The method of any of statements 1-5, further comprising: flowing the well fluid down the tubing string and out through one or more ports of a ported bullnose or shoe during the service operation; and wherein the swellable metallic material is arranged to close the one or more ports of the ported bullnose or shoe upon activation.

Statement 7. The method of any of statement 1-6, wherein the service operation comprises a stimulation treatment, a perforating operation, or a cementing operation.

Statement 8. A well system, comprising: a well tool deployable on a tubing string in an open condition with a flow path of the well tool in fluid communication with the tubing string; a swellable metallic material arranged along the flow path, wherein the flow path is initially open to flow a well fluid over the swellable metallic material; and an activation fluid source for delivering an activation fluid downhole to the well tool to activate the swellable metallic material, wherein the swellable metallic material is arranged to close the flow path of the tool upon activation.

Statement 9. The well system of statement 8, wherein the swellable metallic material is configured to swell by undergoing metal hydration reactions in the presence of brines to form metal hydroxides.

Statement 10. The well system of statement 8, wherein the well tool comprises a central bore in line with the tubing string, and wherein the swellable metallic material is arranged on an inner diameter of the central bore to close the central bore upon activation.

Statement 11. The well system of statement 10, further comprising: one or more valves along the central bore and configured for controlling flow of a formation fluid up through the well tool prior to activating the swellable metallic material.

Statement 12. The well system of statement 11, wherein the one or more valves comprise a float valve and float shoe along the central bore, with the swellable metallic material between the float valve and float shoe.

Statement 13. The well system of statements 11 or 12, wherein the one or more valves comprise a float valve, wherein the swellable metallic material is above the float valve.

Statement 14. The well system of any of statement 8-13, further comprising a tool body defining a central bore, wherein the swellable metallic material is arranged in the central bore to close the central bore upon activation by the activation fluid, without any valve in the tool body.

Statement 15. The well system of any of statements 8-14, further comprising: a ported sub having one or more side ports along the flow path; and wherein the swellable metallic material is arranged in the one or more side ports to close the side ports upon activation.

Statement 16. The well system of any of statements 8-15, further comprising: a ported bullnose or shoe having one or more ports along the flow path at a lower end of the well tool; and wherein the swellable metallic material is arranged to close the one or more ports of the ported bullnose or shoe upon activation.

Statement 17. The well system of any of statements 8-16, further comprising: a casing disposed in a wellbore; wherein the well tool is sealingly engaged with the casing, the well tool including a central bore along the flow path open to a formation below the well tool for delivering a well fluid to the formation to stimulate production of a formation fluid prior to activating the swellable metallic material; and wherein activation of the flow path closes flow of the formation fluid up through the well tool.

Statement 18. The well system of statement 17, wherein the well tool comprises a bridge plug or squeeze packer, and wherein the well tool is sealingly engaged with the casing by the bridge plug or packer.

Statement 19. The well system of any of statements 17-18, wherein the swellable metallic material is configured to swell by undergoing metal hydration reactions in the presence of brines to form metal hydroxides.

Statement 20. The well system of any of statements 8-19, wherein the swellable metallic material is configured to hold at least 500 pounds per square inch (3.47 MPA) after activation to close the flow path.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method, comprising:

deploying a well tool downhole on a tubing string with the well tool in an open condition wherein a flow path of the tool is in fluid communication with the tubing string, the well tool including a central bore along the flow path in line with the tubing string, and with a swellable metallic material arranged along the flow path including on an inner diameter of the central bore;

performing a service operation including flowing a well fluid down the tubing string and through the central bore of the well tool and out a lower end of the central bore; and after performing the service operation, delivering an activation fluid downhole to the well tool to activate the swellable metallic material wherein the swellable metallic material expands to close the central bore of the well tool.

2. The method of claim 1, wherein activating the swellable metallic material comprises undergoing metal hydration reactions in the presence of a brine to form metal hydroxides.

3. The method of claim 1, further comprising:

controlling flow of a formation fluid through the well tool using one or both of a float valve and a float shoe along the central bore of the tool prior to activating the swellable metallic material.

4. The method of claim 1, further comprising:

flowing the well fluid down the tubing string and out through one or more side ports of a ported sub during the service operation; and wherein the swellable metallic material is arranged in the one or more side ports and expands to close the side ports upon activation.

5. The method of claim 1, further comprising:

flowing the well fluid down the tubing string and out through one or more ports of a ported bullnose or shoe during the service operation; and wherein the swellable metallic material is arranged to close the one or more ports of the ported bullnose or shoe upon activation.

6. The method of claim 1, wherein the service operation comprises a stimulation treatment, a perforating operation, or a cementing operation.

7. A well system, comprising:

a well tool deployable on a tubing string in an open condition with a flow path of the well tool in fluid communication with the tubing string, the well tool including a central bore along the flow path and in line with the tubing string;

a swellable metallic material arranged along the flow path, wherein the flow path is initially open to flow a well fluid over the swellable metallic material, wherein at least some of the swellable metallic material is arranged on an inner diameter of the central bore; and an activation fluid source for delivering an activation fluid downhole to the well tool to activate the swellable metallic material, wherein the swellable metallic material is arranged to expands to close the central bore of the tool upon activation.

8. The well system of claim 7, wherein the swellable metallic material is configured to swell by undergoing metal hydration reactions in the presence of brines to form metal hydroxides.

9. The well system of claim 7, further comprising one or more valves along the central bore and configured for controlling flow of a formation fluid up through the well tool prior to activating the swellable metallic material, wherein the one or more valves comprise at least a float valve, wherein the swellable metallic material is above the float valve or between the float valve and a float shoe spaced from the float valve along the central bore.

10. The well system of claim 7, wherein the swellable metallic material is arranged in the central bore to close the central bore upon activation by the activation fluid without any valve in the tool body.

11. The well system of claim 7, further comprising:

a ported sub having one or more side ports along the flow path; and wherein the swellable metallic material is arranged in the one or more side ports to close the side ports upon activation.

12. The well system of claim 7, further comprising:

a ported bullnose or shoe having one or more ports along the flow path at a lower end of the well tool; and wherein the swellable metallic material is arranged to close the one or more ports of the ported bullnose or shoe upon activation.

13. The well system of claim 7, further comprising:

a casing disposed in a wellbore;

wherein the well tool is sealingly engaged with the casing with the flow path open to a formation below the well tool for delivering a well fluid to the formation to stimulate production of a formation fluid prior to activating the swellable metallic material; and wherein activation of the flow path closes flow of the formation fluid up through the well tool.

14. The well system of claim 13, wherein the well tool comprises a bridge plug or squeeze packer, and wherein the well tool is sealingly engaged with the casing by the bridge plug or packer.

15. The well system of claim 13, wherein the swellable metallic material is configured to swell by undergoing metal hydration reactions in the presence of a brine to form metal hydroxides.

16. The well system of claim 7, wherein the swellable metallic material is configured to hold at least 50 pounds per square inch (0.347 MPA) after activation to close the flow path.

17. A well system, comprising:

a well tool deployable on a tubing string in an open condition with a flow path of the well tool in fluid communication with the tubing string;

a swellable metallic material arranged along the flow path, wherein the flow path is initially open to flow a well fluid over the swellable metallic material;

an activation fluid source for delivering an activation fluid downhole to the well tool to activate the swellable metallic material, wherein the swellable metallic material is arranged to close the flow path of the tool upon activation;

wherein the well tool comprises a central bore in line with the tubing string, and wherein the swellable metallic material is arranged on an inner diameter of the central bore to close the central bore upon activation;

one or more valves along the central bore and configured for controlling flow of a formation fluid up through the well tool prior to activating the swellable metallic material; and wherein the one or more valves comprise a float valve and float shoe along the central bore with the swellable metallic material between the float valve and float shoe or wherein the one or more valves comprise a float valve, with the swellable metallic material is above the float valve.

18. The well system of claim 17, wherein the swellable metallic material is configured to swell by undergoing metal hydration reactions in the presence of brines to form metal hydroxides.

19. The well system of claim 17, further comprising a tool body defining a central bore, wherein the swellable metallic material is arranged in the central bore to close the central bore upon activation by the activation fluid, without any valve in the tool body.

20. The well system of claim 17, further comprising:

a ported sub having one or more side ports along the flow path; and wherein the swellable metallic material is arranged in the one or more side ports to close the side ports upon activation.

* * * * *